United States Patent [19]

Valentine

[11] Patent Number: 4,752,154

[45] Date of Patent: Jun. 21, 1988

[54] CONCRETE FINISHING TOOL AND METHOD

[75] Inventor: Roy L. Valentine, Lamar, Miss.

[73] Assignee: C. Earl Gillespie, Jr., Memphis, Tenn. ; a part interest

[21] Appl. No.: 93,534

[22] Filed: Sep. 4, 1987

[51] Int. Cl.[4] ..... E01C 19/44; E01C 19/42

[52] U.S. Cl. ..... 404/72; 404/101; 15/105; 15/235.8; 15/235.4

[58] Field of Search ..... 15/105, 235.4, 235.5, 15/235.6, 235.7, 235.8; 404/72, 96, 97, 98, 101, 118

[56] References Cited

U.S. PATENT DOCUMENTS

| | | | |
|---|---|---|---|
| 1,021,557 | 3/1912 | Runner | 15/235.8 |
| 3,090,066 | 5/1963 | Ferrell et al. | 15/235.8 |
| 3,729,765 | 5/1973 | Peterson | 15/235.8 |
| 3,798,701 | 3/1974 | Irwin et al. | 15/235.8 |
| 4,520,527 | 6/1985 | Maggio et al. | 15/235.8 |

FOREIGN PATENT DOCUMENTS

| | | | |
|---|---|---|---|
| 809340 | 7/1951 | Fed. Rep. of Germany | 15/105 |
| 353393 | 5/1961 | Switzerland | 404/101 |
| 308423 | 3/1929 | United Kingdom | 404/101 |

*Primary Examiner*—Harvey C. Hornsby
*Assistant Examiner*—S. Gerrity
*Attorney, Agent, or Firm*—Walker & McKenzie

[57] ABSTRACT

A finishing tool for trowelling and sweeping the surface of freshly laid concrete slab. The tool includes a trowel member having a front edge and a rear edge; an elongated handle; bracket structure for attaching the handle to the trowel member and for allowing the trowel member to be tilted with the rear edge engaging the concrete slab and with the front edge positioned above the concrete slab and pushed across the concrete slab and to be tilted with the front edge engaging the concrete slab and with the rear edge positioned above the concrete slab and pulled over the concrete slab; a brush member; and attachment structure for attaching the brush member to the trowel member substantially adjacent the front edge of the trowel member and for causing the brush member to sweep the concrete slab when the trowel member is tilted to cause the front edge thereof to engage the concrete slab and when the trowel member is then pulled across the concrete slab.

6 Claims, 2 Drawing Sheets

CONCRETE FINISHING TOOL AND METHOD

BACKGROUND OF THE INVENTION

1. Field of the Invention

The present invention relates, in general, to tools used to finish freshly laid concrete surfaces.

2. Description of the Related Art

The prior art method of trowelling and sweeping concrete consists of first trowelling the concrete slab with a trowel and then, normally, after a period of time allowing the concrete to further harden or "set", sweeping the concrete slab with a separate broom or brush.

A preliminary patentability search conducted in class 15, subclasses 235.4, 235.6 and 235.8 disclosed the following patents: Runner, U.S. Pat. No. 1,021,557; Ferrell et al, U.S. Pat. No. 3,090,066; Peterson, U.S. Pat. No. 3,729,765; Irwin et al, U.S. Pat. No. 3,798,701; and Maggio et al, U.S. Pat. No. 4,520,527. All of the above patents relate to concrete finishing trowels having structure which allows the angle of the handle to be varied with respect to the planar bottom surface of the trowel blade. None of the above patents disclose or suggest the present invention.

SUMMARY OF THE INVENTION

The present invention is directed toward providing an improved tool and method for trowelling and sweeping concrete. The concept of the present invention is to combine a concrete finishing trowel with a cement finishing brush in such a manner that a concrete slab can be finished trowelled and swept in a single push-pull step with the tool.

The finishing tool of the present invention includes, in general, a trowel member having a front edge and a rear edge; an elongated handle; bracket means for attaching said handle to the trowel member and for allowing the trowel member to be tilted with the rear edge engaging the concrete slab and with the front edge positioned above the concrete slab and pushed across the concrete slab and to be tilted with the front edge engaging the concrete slab and with the rear edge positioned above the concrete slab and pulled over the concrete slab; a brush member; and attachment means for attaching the brush member to the trowel member substantially adjacent the front edge of the trowel member and for causing the brush member to sweep the concrete slab when the trowel member is tilted to cause the front edge thereof to engage the concrete slab and when the trowel member is then pulled across the concrete slab.

The method of the present invention comprises, in general, the steps of tilting the trowel member so that the forward edge thereof is positioned above the surface of the concrete slab and the rearward edge thereof engages the surface of the concrete slab, and pushing the trowel member across the concrete slab, and tilting the trowel member so that the forward edge thereof engages the surface of the concrete slab and the rearward edge thereof is positioned above the surface of the concrete slab, and attaching the brush member to the trowel member so that the distal ends of the bristles thereof engage the surface of the concrete slab when the forward edge of the trowel member engages the surface of the concrete slab, and simultaneously pulling the trowel member followed by the brush member across the concrete slab.

One object of the present invention is to reduce the time required to properly trowel and sweep a concrete slab.

Another object of the present invention is to provide means to partially support the weight of a cement finishing brush on a concrete slab to allow the brush to be used before the concrete slab has hardened or "set" to the extent required to properly support the weight of the brush per se.

Other objects and advantages of the present invention will become apparent to those skilled in the art.

DESCRIPTION OF THE PREFERRED EMBODIMENT

Figure 1:
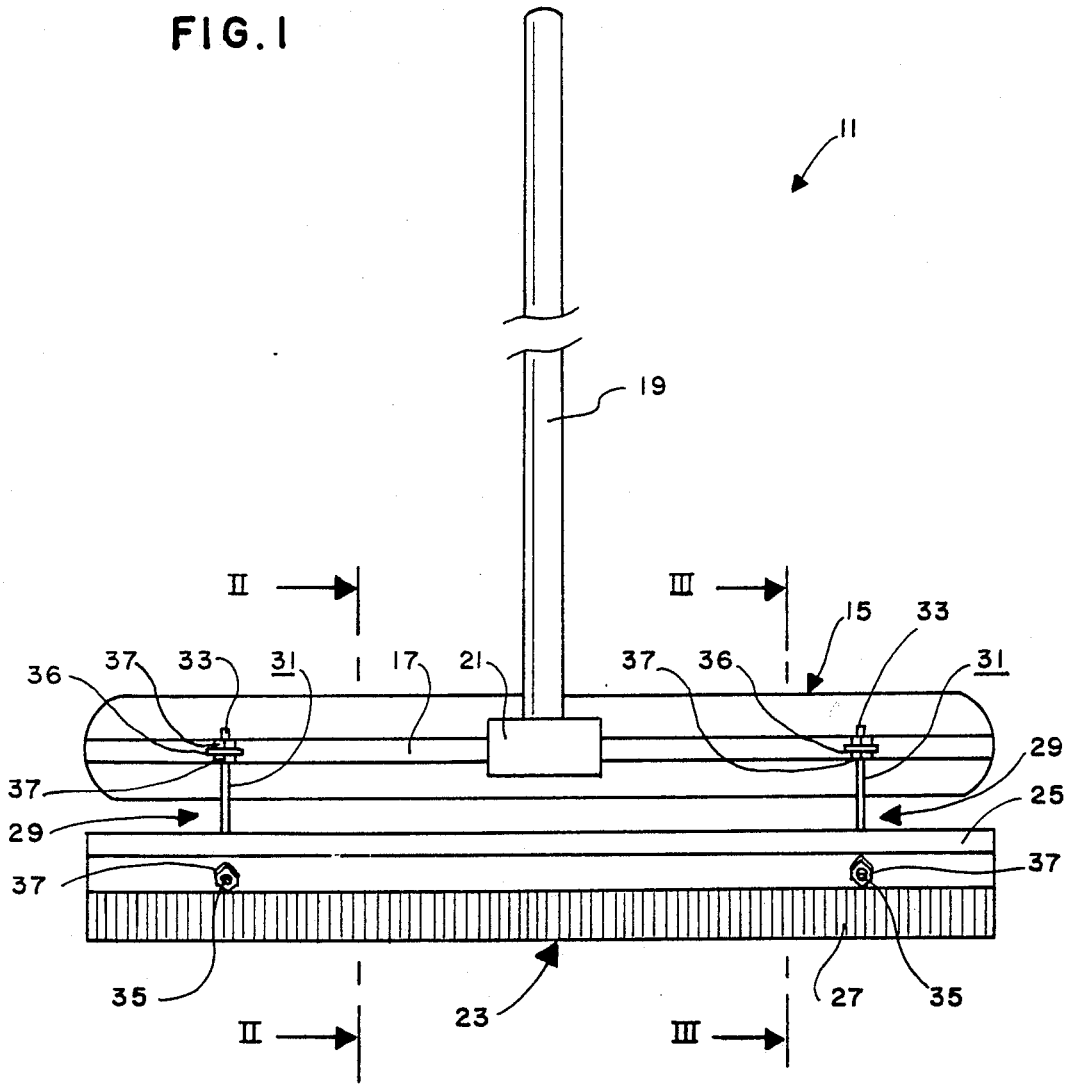
FIG. 1 is a somewhat diagrammatic top plan view of the concrete finishing tool of the present invention.
Figure 2:
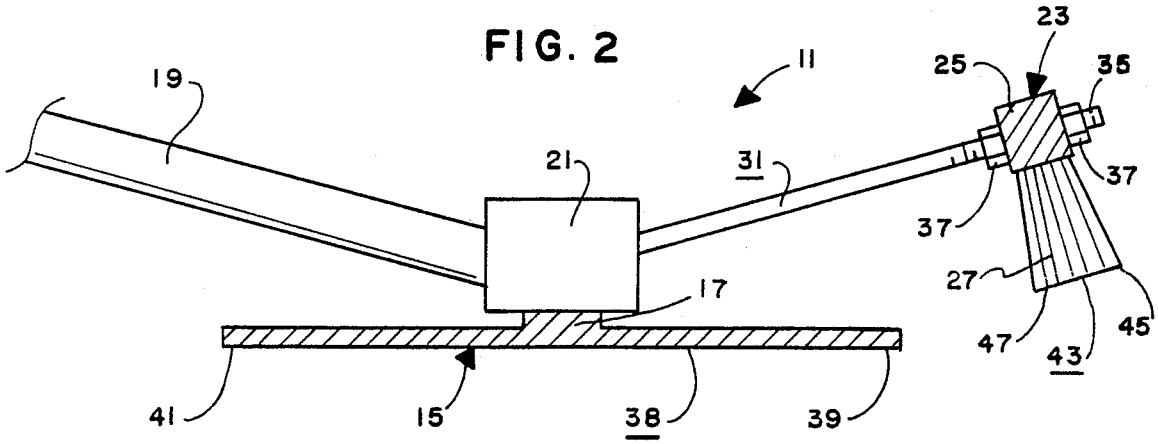
FIG. 2 is an enlarged sectional view as taken on line II—II of FIG. 1.

The concrete finishing tool 11 of the present invention is used to finish the surface of a freshly laid concrete slab 13, or the like. The concrete slab 13 may consist of a driveway, sidewalk, building foundation, etc. In general, the tool 11 is used to first trowel and then sweep the slab 13 after typical initial steps or procedures have been performed on the slab 13 as will now be apparent to those skilled in the art. Thus, the typical initial steps or procedures after the slab 13 has been poured is to level and seal the slab 13 using a straight edge and then a float, etc. The tool 11 can then be used to first trowel and then sweep the slab 13.

The tool 11 includes a trowel member 15. The trowel member 15 preferably includes a substantially rectangular flexible steel blade with an elongated channel or rib 17 extending along the longitudinal axis thereof to reinforce and strengthen the blade. One such trowel member is the "Blue-Glider" trowel, model 16 898M7, sold by Goldblatt Tool Co., 511 Osage, Kansas City, Kans. 66110.

The tool 11 also includes a handle 19 and a bracket means 21 for attaching the handle 19 to the trowel member 15 to allow the trowel member 15 to be pushed and pulled across the slab 13 in a manner as will now be apparent to those skilled in the art. The bracket means 21 preferably consists of the type attachment which allows the pitch of the trowel member 15 to be controlled and adjusted with a simple turn of the handle, or the like. Thus, the bracket means 21 may be a "Hustler" bull float bracket, model 16 290M7, sold by Goldblatt Tool Co., 511 Osage, Kansas City, Kans. 66110.

The tool 11 also includes a broom or brush member 23 for use in sweeping the slab 13. The brush member 23 preferably includes a substantially rigid, elongated body 25 and an elongated row of bristles 27. One such brush member Is the cement finishing brush, model 16 173H7, sold by Goldblatt Tool Co., 511 Osage, Kansas City, Kans. 66110. It is preferred that the brush member 23 be approximately the same length or slightly longer than the trowel member 15.

The tool 11 also includes attachment means 29 for attaching the brush member 23 to the trowel member 15. The attachment means 29 preferably includes one or more substantially rigid arm members 31 having a first end 33 for being attached to the trowel member 15 and having a second end 35 for being attached to the brush member 23. More specifically, the attachment means 29 preferably includes a plurality of flange members 36 fixedly attached to the rib 17 of the trowel member 15, and the ends of the arm members 31 may extend through apertures in the flange members 36 and the body 25 of the brush member 23. The opposite ends of the arm members 31 are preferably threaded and are fixedly attached to the body 25 and the flange members 36 by nuts 37, or the like, as will now be apparent to those skilled in the art.

The relative position of the distal ends of the bristles 27 and the trowel member 15 is critical to the optimum operation of the tool 11. Thus, the trowel member 15 has a substantially flat or planar bottom surface 38 with a forward edge 39 and a rearward edge 41, and the distal ends of the bristles 27 of the brush member 23 coact with one another to form a substantially planar bottom surface 43 with a forward edge 45 and a rearward edge 47. The brush member 23 is substantially rigidly attached to the trowel member 15 by the attachment means 29 so as to position the bottom surface 43 forward of the forward edge 39 and angled relative to the bottom surface 38.

The method of the present invention comprises, in general, the steps of tilting the trowel member 15 so that the forward edge 39 thereof is positioned above the surface of the concrete slab 13 and the rearward edge 41 thereof engages the surface of the concrete slab 13 (see FIG. 3) and pushing the trowel member 15 across the concrete slab 13, and tilting the trowel member 15 so that the forward edge 39 thereof engages the surface of the concrete slab 13 and the rearward edge 41 thereof is positioned above the surface of the concrete slab 13 (see FIG. 4), and attaching the brush member 23 to the trowel member 15 so that the distal ends of the bristles 27 thereof engage the surface of the concrete slab 13 when the forward edge 39 of the trowel member 15 engages the surface of the concrete slab 13, and simultaneously pulling the trowel member 15 followed by the brush member 23 across the concrete slab 13.

Figure 3:
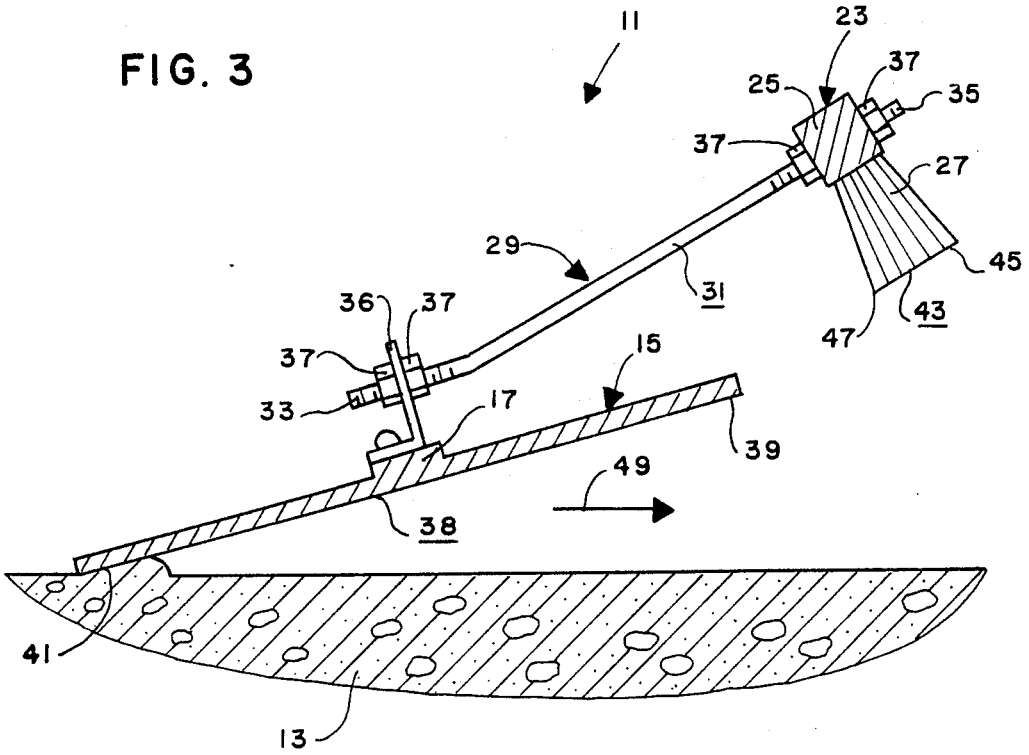
FIG. 3 is an enlarged sectional view substantially as taken on line 111—111 of FIG. 1 but showing the tool in a moved position and associated with a concrete slab.
Figure 4:
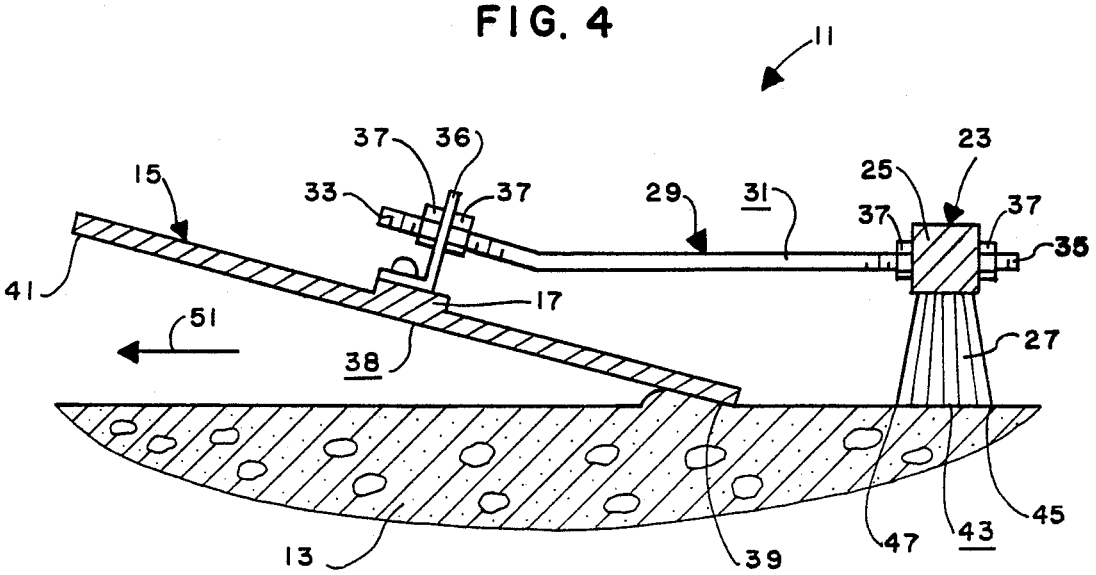
FIG. 4 is a sectional view substantially similar to FIG. 3 but showing the tool in a moved position.

In operation, the tool 11 is used by first tilting the trowel member 15 so that the rearward edge 41 engages the slab 13 and the forward edge 39 and the distal ends of the bristles 27 are located above the slab 13 as clearly shown in FIG. 3. The tool 11 is then pushed over the slab 13 from the near edge of the slab 13 to the far edge of the slab 13 as indicated by the arrow 49 in FIG. 3. The trowel member 15 is then tilted so that the forward edge 39 and the bottom surface 43 oi the bristles 27 engage the slab 13 and the rearward edge 41 is located above the slab 13 as clearly shown in FIG. 4. The tool 11 is then pulled over the slab 13 causing the forward edge 39 of the trowel member 15 as indicated by the arrow 51 in FIG. 4 to finish the trowelling operation on the slab 13 and causing the brush member 23 to "sweep" the slab 13. It will be noted that the trowel member 15 partially supports the weight of the brush member 23 as the slab 13 is "swept" with the brush member 23 to allow the operation to take place substantially immediately after the inital pouring of the slab 13 (i.e., without the normal "setting" period to allow the slab 13 to partially harden) and to allow a longer handle 19 to be used. The handle 19 typically comes in 6 foot sections that can be snapped or otherwise attached together. Using the tool 11, a typical concrete finisher can easily "sweep" a 30 foot wide slab 13 or more. Prior to the present invention, the weight of a brush member would normally limit such "sweeping" steps to less than 30 foot lengths.

Although the present invention has been described and illustrated with respect to a preferred embodiment and a preferred use therefor, it is not to be so limited since modificationa and changes can be made therein which are within the full intended scope of the invention.

I claim:

1. A finishing tool for trowelling and sweeping the surface of freshly laid concrete slab, said tool comprising, in combination;

(a) a trowel member having a front edge and a rear edge;

(b) an elongated handle;

(c) bracket means for attaching said handle to said trowel member and for allowing said trowel member to be tilted with said rear edge engaging said concrete slab and with said front edge positioned above said concrete slab and pushed across said concrete slab, and to be tilted with said front edge engaging said concrete slab and with said rear edge positioned above said concrete slab and pulled over said concrete slab;

(c) a brush member;

(d) attachment means for attaching said brush member to said trowel member substantially adjacent said front edge of said trowel member and for causing said brush member to sweep said concrete slab when said trowel member is tilted to cause said front edge thereof to engage said concrete slab and when the trowel member is then pulled across said concrete slab.

2. The tool of claim 1 in which said trowel member has a substantially planar bottom.

3. The tool of claim 2 in which said brush member includes a substantially rigid, elongated body and an elongated row of bristles.

4. The tool of claim 3 in which the distal ends of said bristles of said brush member coact with one another to define a substantially planar bottom surface.

5. The tool of claim 4 in which said attachment means includes a plurality of substantially rigid arm members having a first end attached to said trowel member and having a second end attached to said brush member.

6. A method of trowelling and sweeping a freshly laid concrete slab, said method comprising the steps of:

(a) tilting a trowel member so that the forward edge thereof is positioned above the surface of said concrete slab and the rearward edge thereof engages the surface of said concrete slab, and pushing said trowel member across said concrete slab; and (b) tilting said trowel member so that the forward edge thereof engages the surface of said concrete slab and the rearward edge thereof is positioned above the surface of said concrete slab, and engaging the surface of said concrete slab with distal ends of bristles of a brush member that is attached to said trowel member when said forward edge of said trowel member engages the surface of said concrete slab, and simultaneously pulling said trowel member followed by said brush member across said concrete slab.

* * * * *